United States Patent [19]

Meichsner et al.

[11] 3,948,648

[45] Apr. 6, 1976

[54] METHOD OF REMOVING SLAG INCRUSTATIONS CONTAINING CALCIUM OXIDE

[75] Inventors: Walter Meichsner, Homberg; Wolfgang Ullrich, Rheinkamp-Baerl; Heinrich Rellermeyer, Duisburg-Hamborn, all of Germany

[73] Assignee: August Thyssen-Hutte AG, Duisburg-Hamborn, Germany

[22] Filed: Jan. 9, 1974

[21] Appl. No.: 431,834

[52] U.S. Cl. ..... 75/46; 75/53; 75/58; 134/2; 134/22 R; 134/42

[51] Int. Cl.[2] ..... C21C 1/02; B08B 9/00

[58] Field of Search ..... 134/2, 42, 22 R; 75/24, 75/30, 56, 58, 53, 46, 94; 432/2

[56] References Cited

UNITED STATES PATENTS

| | | | |
|---|---|---|---|
| 898,116 | 9/1908 | Kretschmer | 75/53 |
| 1,453,734 | 5/1923 | Thomas | 75/53 |
| 3,574,597 | 4/1971 | Lewis et al. | 75/53 |
| 3,827,880 | 8/1974 | Greeson | 75/30 X |

*Primary Examiner*—S. Leon Bashore
*Assistant Examiner*—Marc L. Caroff
*Attorney, Agent, or Firm*—Burgess, Dinklage & Sprung

[57] ABSTRACT

Residual slag incrustations containing calcium oxide are removed from a surface in the presence of which molten iron has been desulfurized by contacting said incrustations with a source of an oxide of boron.

9 Claims, No Drawings

METHOD OF REMOVING SLAG INCRUSTATIONS CONTAINING CALCIUM OXIDE

BACKGROUND OF THE INVENTION

1. Field of the Invention

This invention relates to a method of removing calcium oxide containing residual slag incrustations from surfaces in the presence of which molten iron has been desulfurized by contacting the incrustations with a source of an oxide of boron such as $B_2O_3$ or a boron oxide mineral. More particularly, the present invention is directed to an inexpensive and effective method of removing calcium oxide containing residual slag incrustations from vessels including torpedo ladles employed in the desulfurization of pig iron. The present invention is particularly directed to increasing the capacity of torpedo ladles which have been employed in the desulfurization of pig iron and as a result of such desulfurization have built up a considerable layer of calcium oxide containing residual slag incrustation.

2. Discussion of the Prior Art

In the desulfurization of molten raw iron, especially when torpedo ladles are used for transporting the raw iron from the blast furnace first to a desulfurization system and then, after treatment is completed, to the steelworks, incrustations and deposits of solid residual slag form on the bottom and walls of the ladle after several round trips, if desulfurizers containing calcium are used. In severe cases this results in an appreciable accumulation of residual slag in the torpedo ladle, diminishing the raw iron transporting capacity of the torpedo ladle.

To break up these deposits and "flush out" the torpedo ladle, it has hitherto been the practice after several round trips to treat the molten raw iron exclusively with soda. Such a procedure, however, has the disadvantage that the desulfurization treatment with the calcium-containing desulfurizer has to be interrupted, resulting in operational difficulties in supplying the raw iron with the required quality. Furthermore, very large amounts of soda have to be used in flushing out the torpedo ladle.

The object of the invention consists in avoiding the disadvantages of the previous method of procedure and providing a method whereby it will become possible to remove the residual slag incrustations from the vessel, especially from the torpedo ladle, without interrupting the chosen desulfurization procedure using desulfurizers containing calcium.

SUMMARY OF THE INVENTION

The objects of the present invention are accomplished by a method of removing residual slag incrustations containing calcium oxide from a surface in the presence of which molten iron has been desulfurized which comprises contacting said incrustation with a source of an oxide of boron.

In accordance with the present invention it has been discovered that boric oxide or a compound which yields boric oxide can, at the temperatures of the molten raw iron, markedly decrease the residual slag incrustations which have accumulated on the surfaces of the materials and vessels employed in the desulfurization of molten metal, especially pig iron. Moreover, in accordance with the invention, it has been discovered that only minor amounts of boric oxide containing compounds are required to remove substantial amounts of residual slag incrustations containing calcium oxide.

In accordance with the invention the incrustations are removed by contacting them with boric oxide or a boron compound which supplies boric oxide at an elevated temperature. Generally speaking, the temperature at which the incrustations are contacted with the boron oxide or other boron compound are at or in the neighborhood of the melting point of the metal to be desulfurized, in general between 1000° and 1500°C, preferably between 1050° and 1350°C. While it is contemplated to contact empty vessels such as an empty torpedo ladle with boric oxide, for instance, it has been found that the removal of the slag can be performed virtually simultaneously with the processing of the molten iron. For instance, there can be added to the molten pig iron from the blast furnace, the boric oxide or other boron compound and when the same enters the desulfurrization vessel under the temperatures which prevail in the molten metal bath, the incrustation which adhere to the vessels of the desulfurization zone are removed by the action of the boric oxide. Here, of course, the temperatures which prevail are the temperatures of the molten metal bath.

It has been found to be especially advantageous to introduce the boric oxide or boron compound into the vessel after the pouring of the desulfurized iron, but before the refilling of the vessel with another load of molten metal to be desulfurized. This can be done by introducing the boron compound together with the new load of molten metal or after the new load has entered the desulfurization zone, but before the desulfurization agent is added. Indeed, the boric oxide or other boron compound can be added to the vessels after the vessels have been emptied of the desulfurized molten metal.

It will be realized that numerous boron compounds which can be employed which are sources of boric oxide. These include simple borate salts as well as borate minerals. Borate minerals which can be utilized include the following: colemanite, pandermite, inyoite, hydroboracite, sassolite, tertschite, priceite, meyerhofferite, nobleite, gowerite, natural or synthetic gingorite, inderborite, pinnoite, magnesium metaborate, ascharite, szaibelyite, inderite, kurnakovite, preobrazlienskite, magnesium pyroborate, suanite and other simple earth-alcali metal borates or borate minerals.

Generally speaking, only a minor quantity of boric oxide compound is required to remove major amounts of the incrustations. The process generally involves the use of from 0.1 to 8 wt.% of boric oxide, with reference to the weight of residual slag material. Preferably 1 to 5 wt.% of boric oxide is introduced into the vessel whose surfaces have been in contact with molten iron which has undergone desulfurization by use of a calcium compound such as calcium carbide.

DESCRIPTION OF PREFERRED EMBODIMENTS

The slag incrustations referred to in the application are formed of slags consisting predominantly of solid particles of CaO. They melt at very high temperatures, above the range of common crude iron temperatures. It has been found that these solid particles tend to combine with metal droplets to form larger structures, doing so without the participation of any fluid slag phases which might act as binding agents. What is involved is apparently a mechanical adhesion such as may be observed frequently in very fine substances, such as carbon black for example. Surface phenomena play a very important part in this.

In accordance with the invention, it has surprisingly been found that the addition of small amounts of boric oxide results in the destruction of these agglomerates without the occurrence of any liquefaction of the slags. The boric oxide percentages in accordance with the invention are much too small even for any partial liquefaction of the slags. This is evident, for example, from the known phase diagrams for $CaO—B_2O_3$ and $CaO—SiO_2—B_2O_3$ (allowing for the presence, which is possible in practice, of small amounts of blast furnace slags which are mainly of a calcium silicate composition). Boric oxide contents of more than 25% are required for liquefaction of the slags at molten raw iron temperatures.

The process described herein for the addition of small percentages of boric oxide to desulfurization slags containing CaO, does not, therefore, regardless of how this addition is carried out, produce the known effect of a lowering of the melting point of an already fluid or substantially fluid slag which solidifies upon further cooling of the vessel to form the above-described incrustations. Instead, there is produced a mechanical action which breaks up relatively loose structures consisting of solid slag particles, without liquefaction of same. This effect has heretofore been unknown.

In the application of the process of the invention it has been found that the residual slag left in the torpedo ladle from the previous trips is released from the ladle bottom or walls, as the case may be, during the ladle filling process. At the end of the filling process the released residual slag, which has a dry, free-flowing consistency, floats in clumps on the fluid ladle slag consisting essentially of blast furnace slag spilled out towards the end of the furnace tapping. When the torpedo ladle is emptied at the steelworks the released residual slag flows out of the tilted vessel quite easily together with the iron.

Although there have been reports on the action of boric oxide on the fluidity of blast fornace slags (as, for instance, in "Stahl und Eisen" 58 (1938) No. 38, pp. 1029–1034); the action of the boron oxide does not have any effect upon or has virtually little effect upon the liquefaction of the blast furnace slags. Moreover, the blast furnace slags which are entrained within the raw iron undergoing desulfurization do not have any influence on the release of the residual desulfurization slag, this release being accomplished solely by virtue of the boric oxide. Observation has shown that the residual desulfurization slag remains substantially unliquefied even though up to 8% of boric oxide has been added to the molten metal. The boric oxides bring about the release of the residual slag incrustation from the floor and walls of the torpedo ladle. The chemistry of the process which provides for the release of these residual slags from the surfaces, but does not effect adversely the liquefaction of the slags, is at this time not entirely understood.

In order to more fully illustrate the nature of the invention and the manner of practicing the same the following examples are presented.

EXAMPLE 1

Raw iron was continuously transported in a torpedo ladle having a deadweight of about 252 metric tons from a blast furnace to a desulfurizing system. After completion of the desulfurizing treatment in the torpedo ladle with a calcium-containing desulfurizing agent, the torpedo ladle was poured out at the steelworks and returned to the blast furnace. The amount of raw iron transported was approximately 150 metric tons per round trip, and the amount of desulfurizing agent used per ladle load averaged 500 kg. After 39 round trips the deadweight of the torpedo ladle had risen to about 274 metric tons as a result of incrustation with residual desulfurization slag. The residual desulfurization slag had the following composition:

| | | | |
|---|---|---|---|
| CaO | 43.1% | Fe (granules) | 29.9% |
| | | Mn | 0.31% |
| $SiO_2$ | 2.85% | $Na_2O$ | 0.35% |
| $TiO_2$ | 0.30% | $K_2O$ | 0.10% |
| $Al_2O_3$ | 0.89% | C | 14.7% |
| MgO | 0.20% | S | 3.20% |

During the 40th and 44th round trip, 500 kg of colemanite having a size of 10–50 mm was introduced into the torpedo ladle together with the pouring in of a new load of raw iron at the blast furnace; then the iron was desulfurized as described above and the torpedo ladle was emptied at the steelworks. On the occasion of these trips it was found that the residual desulfurization slag which had collected in the torpedo ladle from trips 1 through 39 had been released from the bottom and from the walls and were floating in clumps consisting of a dry, free-flowing slag on the ladle slag and could be poured off with the latter without difficulty. The deadweight of the torpedo ladle had dropped to about 264 metric tons after the 44th round trip.

EXAMPLE 2

In order to determine whether the blast furnace slag accompanying the metal in Example 1 had any effect on the release of the residual desulfurization slag, an additional series of round trips from the blast furnace to the desulfurizing system and to the steelworks was conducted, during which the torpedo ladle was loaded largely free of slag at the blast furnace.

The deadweight of the torpedo ladle before the series of round trips started was 259 metric tons, the amount of raw iron transported was about 160 metric tons per round trip, and the amount of desulfurizing agent used averaged 550 kg. per ladle load. After 39 round trips the deadweight of the torpedo ladle increased to 273 metric tons due to incrustation with residual slag from the desulfurization process. The residual desulfurization slag had the following composition:

| | | | |
|---|---|---|---|
| CaO | 34.4% | Fe (granules) | 42.6% |
| $SiO_2$ | 1.50% | Mn | 0.53% |
| $TiO_2$ | 0.16% | $Na_2O$ | 0.10% |
| $Al_2O_3$ | 0.48% | $K_2O$ | 0.10% |
| MgO | 0.20% | C | 12.4% |
| | | S | 0.65% |

During the 41st and 43rd to 46th round trip, 500 kg. of colemanite having a size of 10 to 50 mm. was added to the torpedo ladle at each tapping. The deadweight dropped after the 46th round trip to the initial value of 259 metric tons.

Comparison of Example 1 and 2 shows that the presence of blast furnace slag has no effect on the release of the residual desulfurization slag in accordance with the invention.

Although, the invention is predominantly concerned with the desulphurization of raw iron, it is not excluded to proceed accordingly in the desulphurization of other metal melts as of cast iron or preliminary refined iron and steel or refined steel or copper or generally spoken of high melting metals the sulfur content of which can be drastically reduced by treating the melt with desulphurazing agents forming residual slag incrustations on the inner surfaces of the desulphurization container, especially torpedo ladle.

What is claimed is:

1. In a process for refining iron to prepare steel wherein pig iron is initially produced in a blast furnace, thereafter transferred in a molten condition together with some blast furnace slag to a ladle wherein a calcium containing agent is added to desulfurize the pig iron, said ladle is thereafter emptied of desulfurized pig iron which is transferred into a steel making vessel leaving behind in said ladle residual slag incrustations on the inner walls thereof and said ladle is reused for a second charge of pig iron from said blast furnace, the improvement for removing the residual slag incrustations on the walls of said ladle which comprises adding to said ladle a material which is an oxide of boron or a composition which yields an oxide of boron at temperatures at which pig iron melts, which material is added to said ladle such that the boron oxide is present in an amount of between 0.1 and 8 weight percent, based upon the weight of said residual slag incrustations, whereby solid residual slag is dislodged from the walls of said ladle and thereafter removing said solid residual slag from the ladle.

2. A process according to claim 1 wherein said oxide of boron or said composition which yields an oxide of boron is added to said ladle containing the incrustations together with the second charge of molten pig iron.

3. A process according to claim 1 wherein said oxide of boron or said composition which yields an oxide of boron is added to said ladle containing the incrustations before the second charge of pig iron is added thereto.

4. A process according to claim 1 wherein said ladle is a torpedo ladle.

5. A process according to claim 1 wherein the incrustations in said ladle are contacted with said oxide of boron or composition which yields an oxide of boron at a temperature of between 1000° and 1500°C.

6. A process according to claim 5 wherein said incrustations are contacted with said oxide of boron or composition which yields an oxide of boron at a temperature between 1050° and 1350°C.

7. A process according to claim 1 wherein a mineral borate is added as the composition which yields an oxide of boron.

8. A process according to claim 7 wherein said mineral borate is selected from the group consisting of colemanite, pandermite, inyoite and hydroboracite and said mineral borate is added in lump form.

9. A process according to claim 1 wherein the amount of oxide of boron or composition which yields an oxide of boron which is added is between 1 and 5 weight percent, based upon the weight of said residual slag incrustations.

* * * * *